US006341977B1

(12) United States Patent
Nagai et al.

(10) Patent No.: US 6,341,977 B1
(45) Date of Patent: Jan. 29, 2002

(54) PRESSURE-CONTACT TERMINAL

(75) Inventors: Kentaro Nagai; Junko Ishida, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/695,280

(22) Filed: Oct. 25, 2000

(30) Foreign Application Priority Data

Nov. 8, 1999 (JP) ..... 11-317373

(51) Int. Cl.[7] ..... H01R 4/24
(52) U.S. Cl. ..... 439/397; 439/406
(58) Field of Search ..... 439/397, 406, 439/407, 398, 399

(56) References Cited

U.S. PATENT DOCUMENTS 4,806,120 A * 2/1989 Baker ..... 439/399
4,940,425 A 7/1990 Hass et al. ..... 439/397

FOREIGN PATENT DOCUMENTS

JP 9-274941 10/1997

* cited by examiner

*Primary Examiner*—P. Austin Bradley
*Assistant Examiner*—Briggitte R. Hammond
(74) *Attorney, Agent, or Firm*—Finnegan, Henderson, Farabow, Garrett & Dunner, L.L.P.

(57) ABSTRACT

A pressure-contact terminal includes: a contact portion formed on a tip end side of the pressure-contact terminal; and an electric wire connecting portion formed on a rear end side of the pressure-contact terminal have a bottom plate and a pair of side plates which are formed with a plurality of pairs of pressure-contact portions. In the construction, at least a pair of pressure-contact portions of the plurality of pairs of the pressure-contact portions has a pair of pressure-contact blades. Each of the pair of pressure-contact blades includes: a pressure-contact blade main body cut and bent up from the side plates; a blade portion formed on an outer periphery of the pressure-contact blade main body to cut a cover portion of a covered electric wire; a contact portion continuously formed from the blade portion to be in contact with a core of the covered electric wire; and a core retaining portion for retaining the core. The core retaining portion is formed on a lower portion side of the contact portion so as to project inward.

4 Claims, 6 Drawing Sheets

PRESSURE-CONTACT TERMINAL

BACKGROUND OF THE INVENTION

1. Field of the Invention

The present invention relates to a pressure-contact terminal formed with pressure-contact blades between which an end of an electric wire is press-fitted.

2. Description of the Related Art

Conventionally, there is a known pressure-contact terminal 1 as a pressure-contact terminal of this type as disclosed in U.S. Pat. No. 4,940,425 as shown in FIG. 1. As shown in FIG. 1, the pressure-contact terminal 1 is formed at its front end side with a contact portion 2 for connection to an opposed terminal and at its the other side with an electric wire connecting portion 3 for retaining an electric wire and for connection to the electric wire. The electric wire connecting portion 3 is formed with pressure-contact portions 6, 7, 8, and 9 hammered inward to bulge from a pair of side walls 4 and 5. The electric wire connecting portion 3 is formed at its rear end portion with a pair of electric wire retaining chips 10 and 11.

By the pressure-contact terminal 1 with such a structure, by press-fitting a covered electric wire in the electric wire connecting portion 3, the pressure-contact portions 6, 7, 8, and 9 cut the cover to bring an exposed core into contact with the pressure-contact portions 6, 7, 8, and 9, thereby establishing connection.

In the above-described pressure-contact terminal 1, the pressure-contact portions 6, 7, 8, and 9 to be connected to the electric wire and to retain the electric wire have shapes formed by hammering the side plates 4 and 5 inward and bending tip end portions (tip end portions in bulging directions). Therefore, axial retaining force of the pressure-contact portions 6, 7, 8, and 9 is small if load is applied in an axial direction to the electric wire connected to the pressure-contact terminal 1.

SUMMARY OF THE INVENTION

Therefore, it is an object of the present invention to provide a pressure-contact terminal that can reliably retain an electric wire against attraction in an axial direction of the electric wire.

The present invention has been achieved with such points in mind.

According to a first aspect of the present invention, there is provided a pressure-contact terminal comprising: a contact portion to be in contact with an opposed terminal and formed on a tip end side of the pressure-contact terminal; and an electric wire connecting portion formed on a rear end side of the pressure-contact terminal, the electric wire connecting portion having a bottom plate and a pair of side plates formed by bending from both sides of the bottom plate in the same direction, the pair of side plates being formed with a plurality of pairs of pressure-contact portions; wherein at least a pair of pressure-contact portions out of the plurality of pairs of the pressure-contact portions has a pair of pressure-contact blades; and each of the pair of pressure-contact blades includes: a pressure-contact blade main body cut and bent up from the side plates; a blade portion formed on an outer periphery of the pressure-contact blade main body to cut a cover portion of a covered electric wire; a contact portion continuously formed from the blade portion to be in contact with a core of the covered electric wire; and a core retaining portion for retaining the core, the core retaining portion being formed on a lower portion side of the contact portion so as to project in such a direction as to approach to the other one of the pair of pressure-contact blades and to be brought into contact with the cover portion of the covered electric wire, thereby preventing coming off of the covered electric wire from the pressure-contact portions.

In this pressure-contact terminal, the covered electric wire is placed on the electric wire connecting portion and is pressed-fitted between the pressure-contact blades by using a pressure-contact jig or the like. If the covered electric wire is press-fitted between the pressure-contact blades, the cover portion of the covered electric wire is cut by the blade portions and the exposed core comes in contact with the contact portions. As a result, the covered electric wire is electrically connected to the pressure-contact terminal. In this case, end faces of the cut cover portion come in contact with the pressure-contact blade main bodies and with the core retaining portions formed on the pair of pressure-contact blades of at one of the plurality of pairs of pressure-contact portions. Thus, the covered electric wire can be reliably retained against attraction in an axial direction of the electric wire.

According a second aspect of the invention as it depends from the first aspect, in addition to an arrangement of the first aspect, there is provided a pressure-contact terminal, wherein the core retaining portions have retaining contact portions to come in contact with the core to be connected in a conductive manner to the core.

In this pressure-contact terminal, in addition to the operation of the first aspect, because the core of the covered electric wire comes in contact with the retaining contact portions, the electric connection between the covered electric wire and the pressure-contact terminal can be established.

According to a third aspect of the invention as it depends from the first or the second aspect, in addition to arrangements of the first and second aspects, there is provided a pressure-contact terminal, wherein the other pair of pressure-contact portions which have not the pressure-contact blades are formed in such a manner that the pair of side plates are projected inward each other by hammering operations.

In this pressure-contact terminal, in addition to the operation of the first and second aspects, the electric wire can be reliably retained by using the pressure-contact portions formed by hammering. In other words, although the pressure-contact portions formed by hammering the opposite side plates to project inward have small retaining force against the attraction in the axial direction of the covered electric wire, the electric wire can be retained reliably against the attraction in the axial direction of the electric wire because the core retaining portion is formed on the pressure-contact blade of at least one pressure-contact portion.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
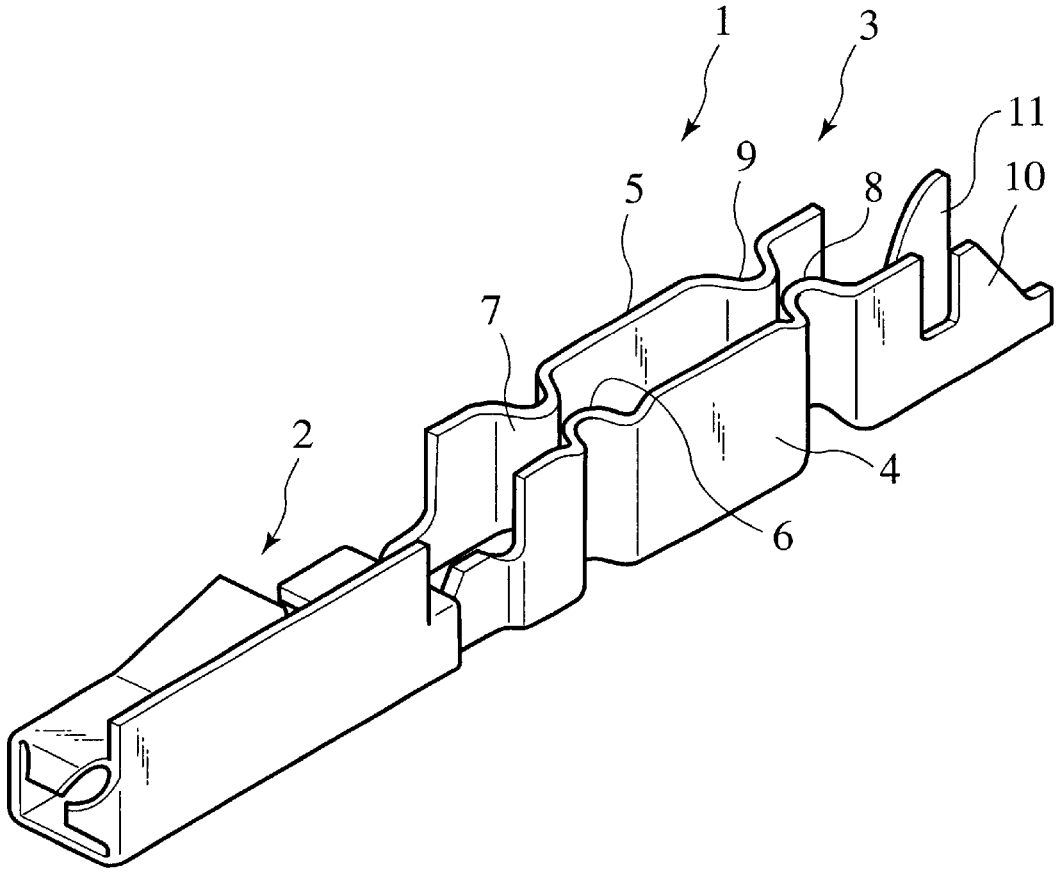
FIG.1 PRIOR ART
FIG. 1 is a perspective view showing a prior-art pressure-contact terminal.

There will be detailed below the preferred embodiments of the present invention with reference to the accompanying drawings. Like members are designated by like reference characters.

Figure 2:
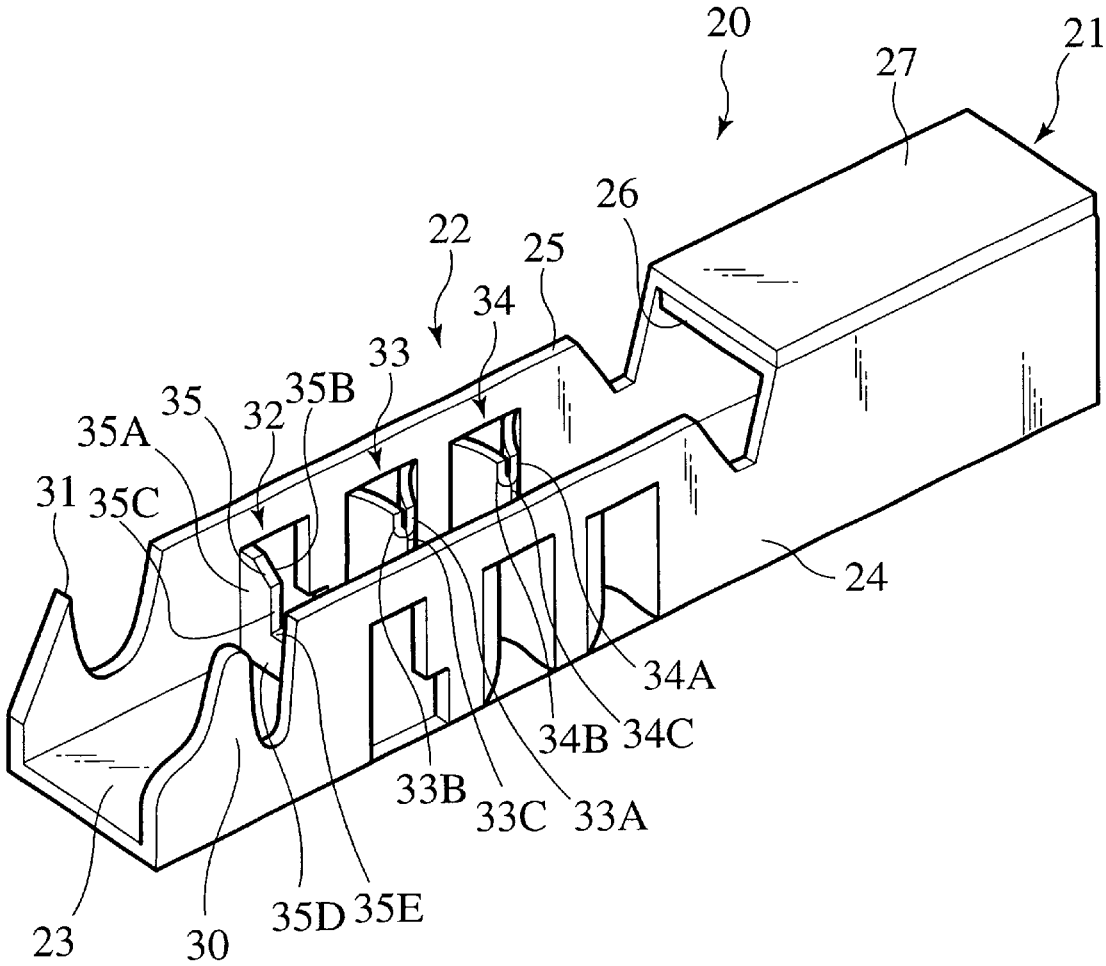
FIG. 2 is a perspective view of an embodiment of a pressure-contact terminal according to the present invention.
Figure 3:
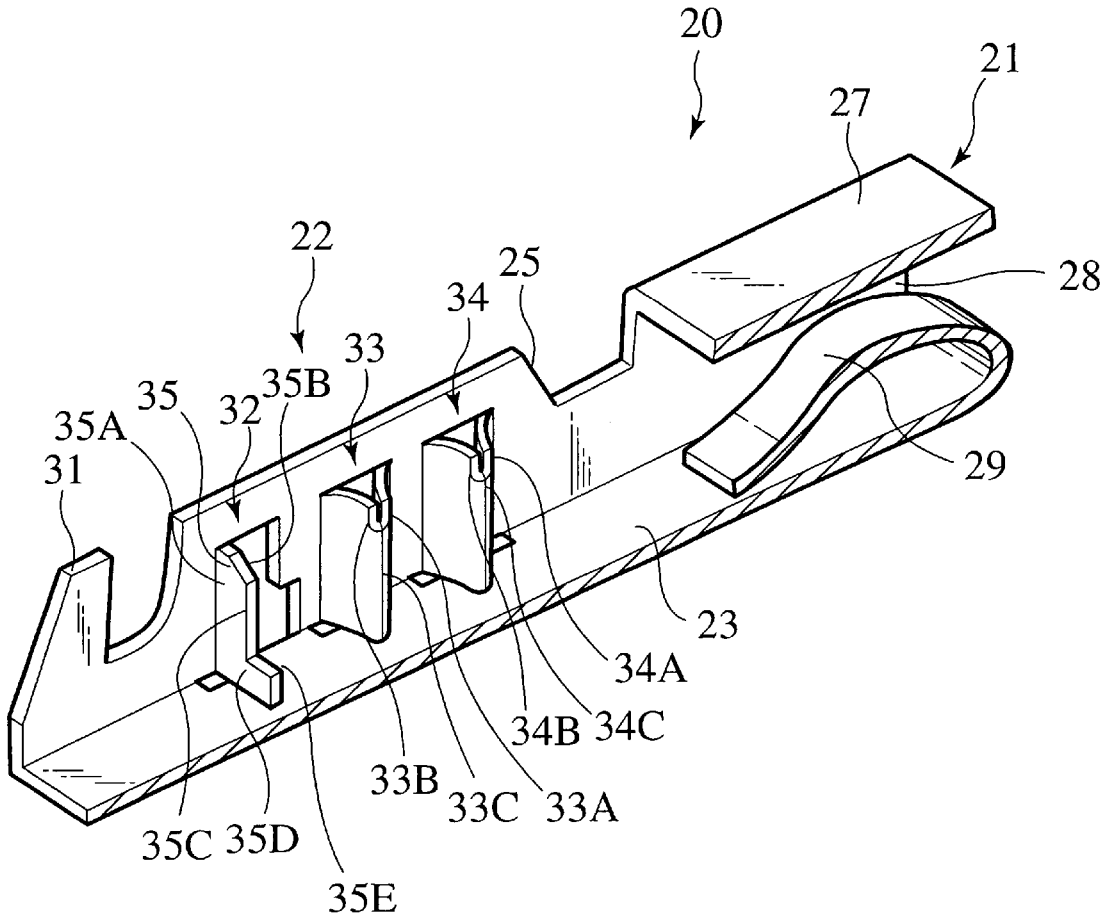
FIG. 3 is a sectional perspective view of the pressure-contact terminal of the embodiment.
Figure 4:
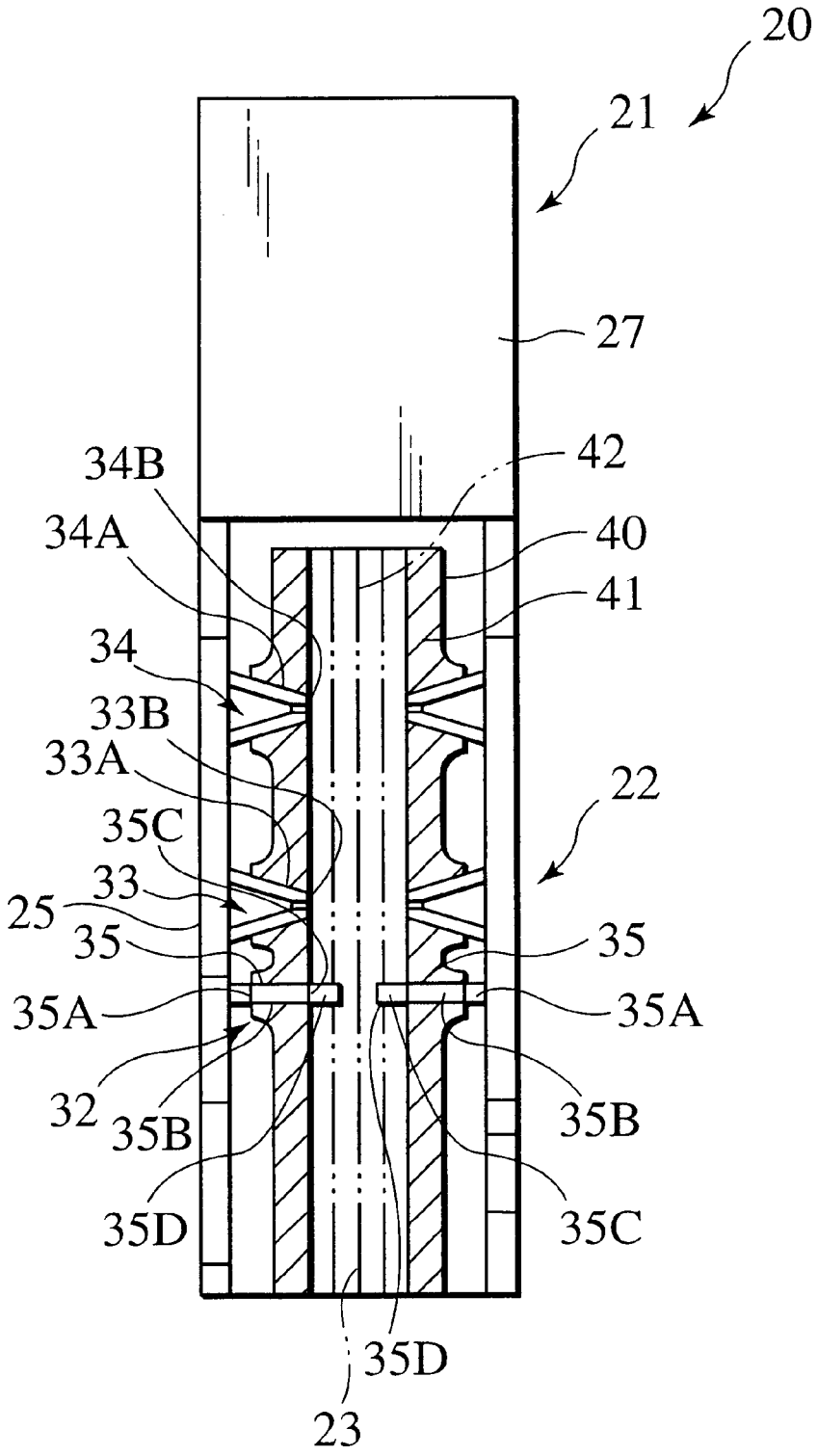
FIG. 4 is a plan view of a pressure-contact terminal of the embodiment.

FIG. 2 is a perspective view of the pressure-contact terminal 20 of the present embodiment, FIG. 3 is a sectional perspective view of the pressure-contact terminal 20 that is cut away at a center in a width direction, and FIG. 4 is a plan view of the pressure-contact terminal 20. As shown in FIGS. 2 to 4, the pressure-contact terminal 20 is formed on its front end side with a contact portion 21 to be in contact with an opposed terminal and on its rear end side with an electric wire connecting portion 22.

The contact portion 21 and the electric wire connecting portion 22 are formed along a common bottom plate 23. Side plates 24 and 25 standing to be perpendicular to the bottom plate 23 are formed on opposite side edges in a width direction of the bottom plate 23. The side plates 24 and 25 face each other in parallel to each other.

The contact portion 21 includes top plates 26 and 27 respectively extending from upper edges of the side plates 24 and 25, the top plates 26 and 27 being bent such that one is placed on the other. A contact spring chip 29 extending from a front end edge of the bottom plate 23 toward a rear end side is housed and disposed in a cavity (see FIG. 3) 28 surrounded by the bottom plate 23, the side plates 24 and 25, and the top plates 26 and 27. The contact spring chip 29 is curved toward the top plate 26 side and presses the opposed terminal against an inner face of the top plate 26 to establish electric connection when the opposed terminal is press-fitted from a front end side of the contact portion 21.

The electric wire connecting portion 22 is formed on its rear end side with a pair of electric wire retaining chips 30 and 31. Between the electric wire retaining chips 30, 31 and the contact portion 21, three pairs of pressure-contact portions 32, 33, and 34 are respectively provided. The pressure-contact portion 32 on the electric wire retaining chips 30, 31 side has a pair of pressure-contact blades 35 formed by cutting and bending the side plates 24 and 25 inward and the pressure-contact portions 33 and 34 are formed by hammering the side plates 24 and 25 inward.

Figure 5:
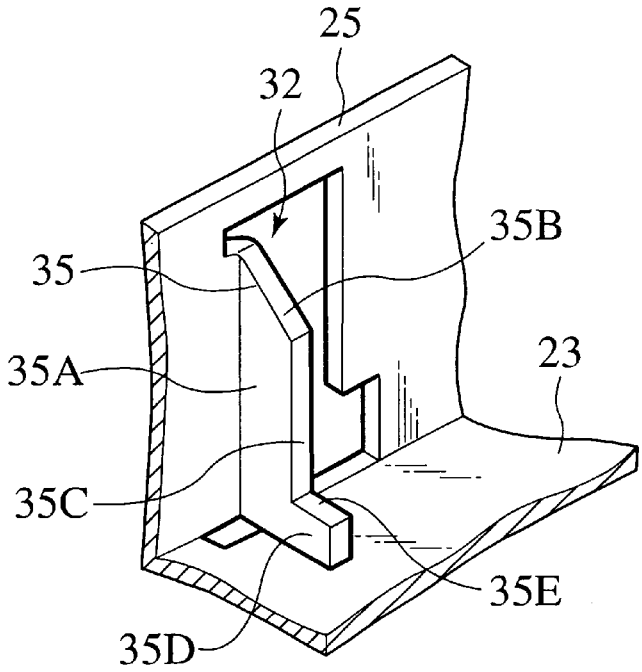
FIG. 5 is a partially cutaway perspective view of the pressure-contact terminal of the embodiment.

As shown in FIG. 5, the pair of pressure-contact blades 35, 35 of the pressure-contact portion 32 include pressure-contact blade main bodies 35A, 35A cut and bent from the opposite side plates 24 and 25, blade portions 35B, 35B formed on outer peripheries of the pressure-contact blade main bodies 35A and 35A to cut a cover portion 41 of a covered electric wire 40, contact portions 35C formed to continue from the blade portions 35B, 35B and to be in contact with a core 42 of the covered electric wire 40, and core retaining portions 35D, 35D formed on lower portion sides of the contact portions 35C, 35C.

The blade portions 35B and 35B are inclined toward the bottom plate 23 to guide the covered electric wire 40 to the space between the pressure-contact blade main bodies 35A, 35A and to cut the cover portion 41 of the covered electric wire 40 that slides on the slopes. The contact portions 35C, 35C are formed along a vertical direction to come in contact with the core 42 exposed between pieces of the cover portion cut by the blade portions 35B, 35B, thereby establishing electric connection between the covered electric wire 40 and the pressure-contact terminal 20.

The core retaining portions 35D, 35D are formed into substantially right-angled shapes to project in such directions as to approach each other from the pressure-contact blade main bodies 35A, 35A. An end face (lower portion side) of the cut cover portion 41 of the covered electric wire 40 comes in contact with the core retaining portions 35D, 35D. The core retaining portions 35D, 35D are formed on faces that continue from the contact portions 35C, 35C with retaining contact portions 35E, 35E to be in contact with and connected in a conductive manner to the core 42.

Next, structures of the pressure-contact portions 33 and 34 will be described. The pressure-contact portions 33 and 34 are formed by hammering the side plates 24 and 25 inward (toward an inner side of the pressure-contact terminal) and have plan shapes of V as shown in FIG. 4. At upper portions of tip ends of the pressure-contact portions 33 and 34 projecting toward the other side plate 24 or 25 out of the side plates 24 and 25 formed with the pressure-contact portions 33 and 34, slits 33A and 34A are formed. By forming the slits 33A and 34A, the upper portions of the tip ends of the pressure-contact portions 33 and 34 are sharpened to form blade portions 33B and 34B, thereby facilitating rupturing of an insulating cover 41 of the covered electric wire 40. Lower portion sides of the blade portions 33B and 34B are contact faces 33C and 34C.

Distances between the pressure-contact portions 33, 33 and the pressure contact portions 34, 34 that respectively pair up with each other are set at dimensions slightly smaller than the core 42 of the covered electric wire 40 as shown in FIG. 4. Therefore, if the covered electric wire 40 is press-fitted between the pressure-contact portions 33 and 34, the cover portion 41 is cut and exposed core 42 comes in contact with the contact faces 33C and 34C, thereby establishing electric connection between the covered electric wire and the pressure-contact terminal 20.

Figure 6:
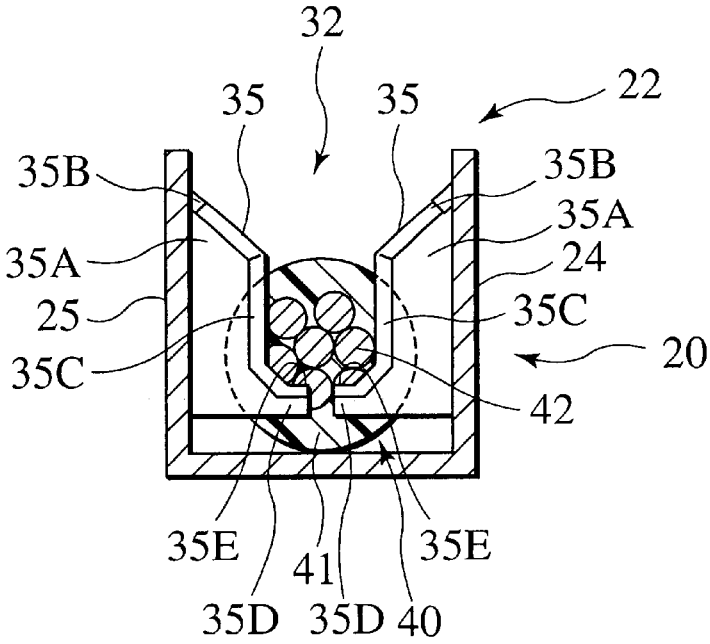
FIG. 6 is a sectional view showing a state in which a covered electric wire is mounted to the pressure-contact terminal of the embodiment.

Next, operation of the pressure-contact terminal 20 of the embodiment on the covered electric wire will be described. First, when an end of the covered electric wire 40 is press-fitted in the electric wire connecting portion 22, an outer peripheral face of the insulating cover 41 of the covered electric wire 40 is cut by the blade portions 35B, 35B, 33B, and 34B. Then, the cover portion 41 of the covered electric wire 40 is cut and the core 42 is exposed and comes in contact with the contact portions 35C, 35C, and the contact faces 33C and 34C. FIG. 6 shows a state in which the covered electric wire 40 is connected to the electric wire connecting portion 22. A lower face side of the core 42 of the covered electric wire 40 is supported by the core retaining portions 35D, 35D and the retaining contact portions 35E, 35E are in contact with the core 42. In this state, opposite sides of the cut cover portion 41 are in contact with the pressure-contact blade main bodies 35A, 35A and the core retaining portions 35D, 35D as shown in FIG. 4.

According to the present embodiment, because the core retaining portions 35D, 35D are formed on the pressure-contact blades 35, 35 of the pressure-contact portions 32, it is possible to reliably retain the electric wire 40 against attraction in an axial direction of the electric wire 40.

Although the other pressure-contact portions 33 and 34 are formed by hammering the opposite side plates 24 and 25, the cut cover portion 41 of the covered electric wire 40 comes in contact with the core retaining portions 35D, 35D of the pressure-contact portions 32, thereby reliably retaining the covered electric wire 40 and establishing reliable electric connection.

Because the retaining contact portions 35E, 35E are formed on the core retaining portions 35D, 35D, the number of contact portions with the core 42 can be increased, thereby establishing further reliable electric connection.

Although the embodiment has been described above, the present invention is, not limited to the embodiment and various modifications accompanying summary of the structure may be made. For example, although three pairs of pressure-contact portions are provided in the above-described embodiment, the covered electric wire can be retained reliably with a structure including two or more pairs of pressure-contact portions.

Figure 7:
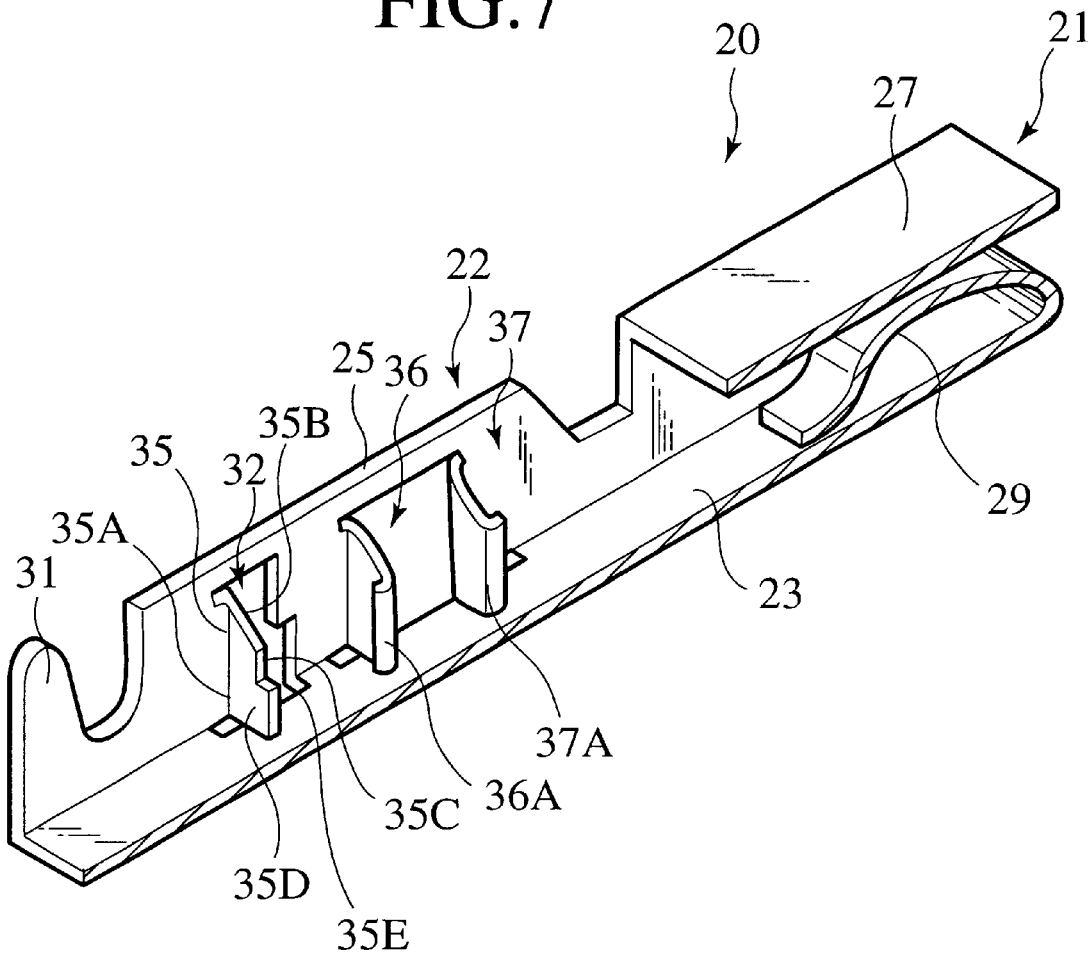
FIG. 7 is a sectional perspective view of a modification of the embodiment.

FIG. 7 is a sectional perspective view showing a modification of the above-described embodiment. Although the pressure-contact portions 33 and 34 are formed by hammering in the above embodiment, the pressure contact portions 36 and 37 are formed by bending the side plate 25 in the modification shown in FIG. 7. Tip end portions of the pressure-contact portions 36 and 37 are formed as bent portions 36A and 37A by bending a metal plate.

According to the modification, because upper faces of the pressure-contact portions 36 and 37 are sections formed by cutting the side plate 25, it is easier to capture the cover portion 41 of the covered electric wire 40, thereby increasing retaining force in the axial direction of the covered electric wire 40. Other structures of the modification are similar to those of the above embodiment.

Although the pressure-contact terminal 20 is formed by bending the sheet of metal plate in the developed shape, it is possible to form a plurality of members integrally with the pressure-contact terminal.

The entire contents of Japanese Patent Application P11-317373 (filed Nov. 8, 1999) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A pressure-contact terminal, comprising:

a contact portion to be in contact with an opposed terminal and formed on a tip end side of the pressure-contact terminal;

an electric wire connecting portion formed on a rear end side of the pressure-contact terminal, the electric wire connecting portion having a bottom plate and a pair of side plates formed by bending from both sides of the bottom plate in the same direction, the pair of side plates being formed with a plurality of pairs of pressure-contact portions;

wherein at least a pair of the pressure-contact portions has a pair of pressure-contact blades; and wherein each of the pair of pressure contact blades includes:

a pressure-contact blade main body cut and bent inwardly from the side plates;

a blade portion formed on an outer periphery of the pressure-contact blade main body to cut a cover portion of a covered electric wire;

a contact portion to be in contact with a core of the covered electric wire, the contact portion being straight and continuously formed from the blade portion; and a core retaining portion formed on a lower portion side of the contact portion and projecting inwardly farther than the blade portion and the contact portion to be brought into contact with the cover portion of the covered electric wire, thereby preventing the covered electric wire from disengaging from the pressure contact portions when load is applied to the covered electric wire in an axial direction.

2. The pressure-contact terminal according to claim 1, wherein at least a pair of the pressure-contact portions does not have the pressure-contact blades and is formed in such a manner that the pair of side plates are projected inward each other by hammering operations.

3. The pressure-contact terminal according to claim 1, wherein the core retaining portions have retaining contact portions to come in contact with the core to be connected in a conductive manner to the core.

4. The pressure-contact terminal according to claim 3, wherein at least a pair of the pressure-contact portions does not have the pressure-contact blades and is formed in such a manner that the pair of side plates are projected inward each other by hammering operations.

* * * * *